US005418986A

United States Patent [19]

Warkus et al.

[11] Patent Number: 5,418,986

[45] Date of Patent: May 30, 1995

[54] ATTACHMENT PLATE FOR MOUNTING FOR EXAMPLE SANITARY FIXTURE

[75] Inventors: Clemens Warkus, Wald; Adolf Schweigert, Salem, both of Germany

[73] Assignee: Geberit AG, Jona, Switzerland

[21] Appl. No.: 86,250

[22] Filed: Jul. 1, 1993

[30] Foreign Application Priority Data

Jul. 20, 1992 [CH] Switzerland ..... 02280/92

[51] Int. Cl.[6] ..... F16L 3/22; F16L 3/24

[52] U.S. Cl. ..... 4/670; 4/695; 4/643; 285/150; 248/911; 248/912

[58] Field of Search ..... 4/670, 695, 696, 252.1, 4/252.2, 252.3, 643, 647, 648; 248/68.1, 911, 912, 222.3, 689; 205/150

[56] References Cited

U.S. PATENT DOCUMENTS

| | | | |
|---|---|---|---|
| 1,471,154 | 10/1923 | Graham | 4/252.2 |
| 3,097,843 | 7/1963 | Morrow | 4/695 |
| 3,129,437 | 4/1964 | McClenahan | 4/252.2 |
| 3,186,051 | 6/1965 | Waddell | 248/68.1 |
| 3,701,172 | 10/1972 | McClenahan | 4/252.2 |
| 4,427,171 | 1/1984 | Frederiksen | 248/68.1 |
| 4,909,461 | 3/1990 | Collins | 248/68.1 |
| 5,265,284 | 11/1993 | Dottori et al. | 4/695 |

FOREIGN PATENT DOCUMENTS

| | | | |
|---|---|---|---|
| 2517723 | 6/1983 | France | 4/670 |

*Primary Examiner*—Henry J. Recla
*Assistant Examiner*—Charles R. Eloshway
*Attorney, Agent, or Firm*—Bucknam and Archer

[57] ABSTRACT

The attachment plate has a rectangular planar front wall (2) with two groups (3) each with three mounting sites (3a–3c). These groups are used for mounting sanitary fixtures such as for example isolating valves and the like. The two groups (3) have in each instance two mounting sites (3b, 3c) disposed on a straight line (A). Each group (3) has moreover at least one third mounting site (3a) at a distance (Y) one from the other which is different from the distances (X, Z) of the remaining mounting sites (3b, 3c). The mounting sites (3a–3c) are disposed in such a manner on the attachment (1) that all commonly used sanitary fixtures and the like can be mounted.

9 Claims, 4 Drawing Sheets

ATTACHMENT PLATE FOR MOUNTING FOR EXAMPLE SANITARY FIXTURE

The present invention relates to an attachment plate for mounting for example sanitary fixtures such as for example isolating valves, safety groups, corner valves and surface fixtures, in particular for installation of fronting walls, with at least two mounting sites disposed in a face wall of the plate.

BACKGROUND OF THE INVENTION

A known fixture plate of this type comprises two mounting sites disposed at a distance one from the other in the form of breakthroughs. The one breakthrough is a circular bore and the other breakthrough is formed by two overlapping bores. The one or the other of the overlapping bores may be used for mounting for example a fixture so that in this attachment plate two different gauges for bore holes are available, a fact which simplifies the storage of such fixture plates. In practice, however, a large number of gauges for bore holes are required since the selection of different sanitary fixtures is very large. Consequently, several types of the known attachment plates would have to be kept in stock.

An attachment plate or mounting device is also known on which fixtures placed onto the front wall can be mounted at the front face by means of self-tapping screws. The fixtures are here provided with an outer flange on which they are mounted to the plate by screws. The mounting sites in this attachment plate are bores disposed circularly into which the tapping screws are screwed when mounting a fixture. In this case the conduits leading to the fixtures are not carried through the attachment plate but rather laterally away from it. With this plate the difficulty also exists that there must be kept several implementations in stock.

SUMMARY OF THE INVENTION

The object of the present invention is to provide a fixture plate of the stated type which is suitable for all fixtures. The fixture plate should nevertheless be capable of being manufactured in compact construction and with comparatively small external dimensions. The object is achieved according to the invention as defined to claim 1. In an attachment plate with the configuration defined in the characterizing part of claim 1 of the mounting sites, six mounting sites suffice in order to be able to mount the most common fixtures. An optimum number of mounting sites in an optimal configuration is also described. The configuration defined here nevertheless permits a very compact implementation of the fixture plate, and also permits the implementation of a further mounting site on the center line of the plate for the central mounting of a fixture. The front wall can be for example rectangular and can be produced with comparatively small external dimensions and comparatively small distances of the breakthroughs from the edge of the plate. It is also essential that the configuration of the mounting sites in two groups with three mounting sites each and also in the implementation with a seventh central mounting site be configured very distinctly. Consequently the mounting is at least as simple as it has been in the prior art.

Recesses comprising several overlapping breakthroughs, which can impair the stability of the attachment plate, can be avoided.

The dimensions and configurations stated in the dependent claims permit a still further optimization of the opening of the attachment.

BRIEF DESCRIPTION OF THE DRAWINGS

The examples of the attachment plate according to the invention will be explained in further detail by reference to the drawings of which.

DESCRIPTION OF THE PREFERRED EMBODIMENTS

Figure 1:
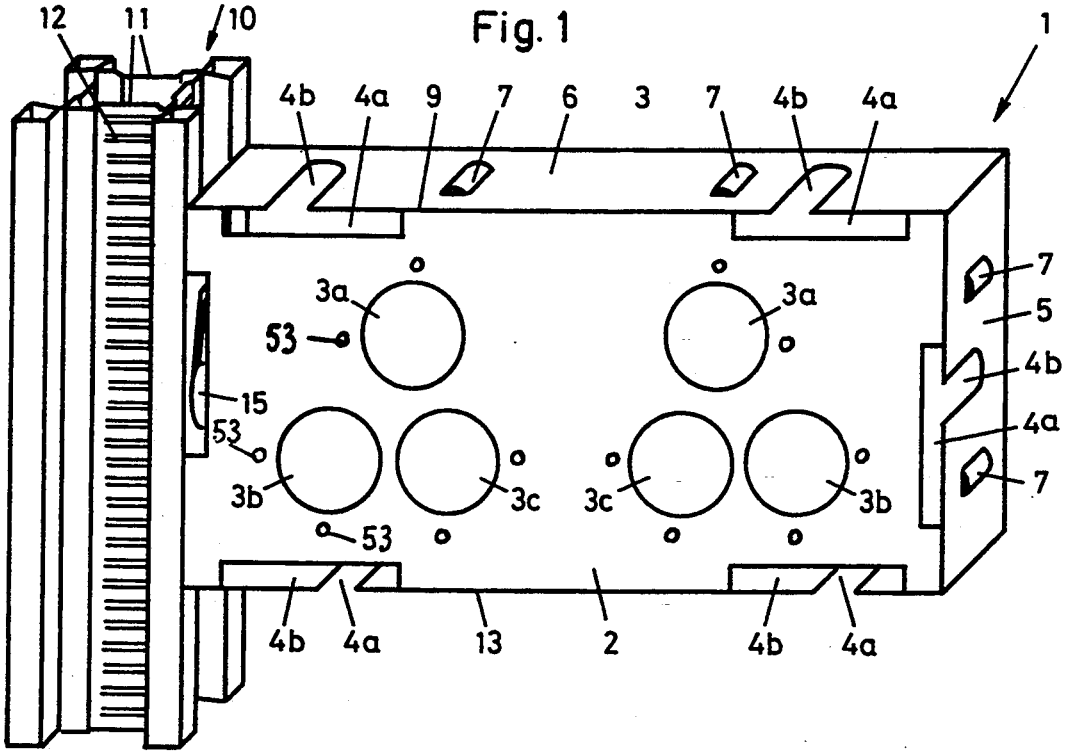
FIG. 1 is a perspective view of an attachment plate according to the invention which is mounted on a supporting frame shown here only segmented.

The attachment plate 1 shown in FIG. 1 comprises a rectangular and planar front wall 2 and side walls 5 and 6 bent towards the rear at 90°. For mounting the attachment plate 1 on a supporting frame 10 shown here only partially, the plate has recesses 4*a* and 4*b* in the front face 2 and in the side walls 5 and 6. Latch 15, which is only barely shown, may be introduced through the recesses. The latch connects detachably the attachment plate 1 with the supporting frame 10 whereby it engages with a head, not shown here, dovetail grooves 11 as well as channels 12. As a rule, the attachment plate 1 is connected with several latches 15 of the same type on opposite sides with the frame 10. For positioning the attachment plate 1 on the frame 10 the side walls 5 and 6 comprise projecting lugs 7. In the same manner the attachment plate 1 may also be mounted on frame 10 rotated by 90° so that the side walls 6 also are in contact with the support of the frame 10.

The front wall 2 comprises two groups 3 of three mounting sites each in the form of breakthroughs 3*a*, 3*b*, and 3*c*. The two groups 3 are disposed symmetrically in mirror image with respect to a line S. The breakthroughs 3*a* and 3*c* are preferably circular and have a diameter of 30 to 36 mm, preferably 33 mm. The centers of breakthroughs 3*b* and 3*c* are disposed on a straight line A which is parallel to a lower edge 13. It is clear especially in FIG. 1 that in each group 3 the breakthrough 3*a* is disposed above the two breakthroughs 3*b* and 3*c*. However, the distance between the two breakthroughs 3*a* is different from the distance between the two breakthroughs 3*c* and also different from the distance between the two breakthroughs 3*b*. Furthermore, the distance between the two breakthroughs 3*a* is different from the average of the distances between breakthroughs 3*c* or 3*b*, respectively. The corresponding distances are denoted in FIG. 2 with X, Y, and Z. The distance between line A and line B through the centers of breakthroughs 3*a* is designated by W. For the greatest possible applicability of the attachment plate 1 these distances as well as the diameter of the breakthroughs 3*a* to 3*c* are essential and are given in the following table.

W=40 mm
X=153 mm
Y=100 mm
Z=76.5 mm

Deviations from the above distances are possible but lead, as a rule, to an opening which is less than the optimum. Deviations of the diameter of the breakthroughs 3*a* to 3*c* as well as deviations from the circular shape of these breakthroughs are also conceivable. Conceivable is also an implementation in which the front face 2 comprises more than 6 breakthroughs for leadthroughs. An attachment plate with a seventh mounting site on the line of symmetry S would also be suitable for an additional central mounting of a fixture.

The front face 2 is preferably rectangular and has a length L of 248 mm and a height H of 120 mm. The depth of the side walls 5 and 6 is designated by T in FIG. 2 and is preferably 32 mm. For an especially optimal implementation of the fixture plate 1 these dimensions are also essential but it is understood that slight deviations are possible. The dimension T corresponds preferable to the profile width.

In FIGS. 2 to 5 are shown some typical examples of the applications of attachment plate 1 according to the invention.

Figure 2:
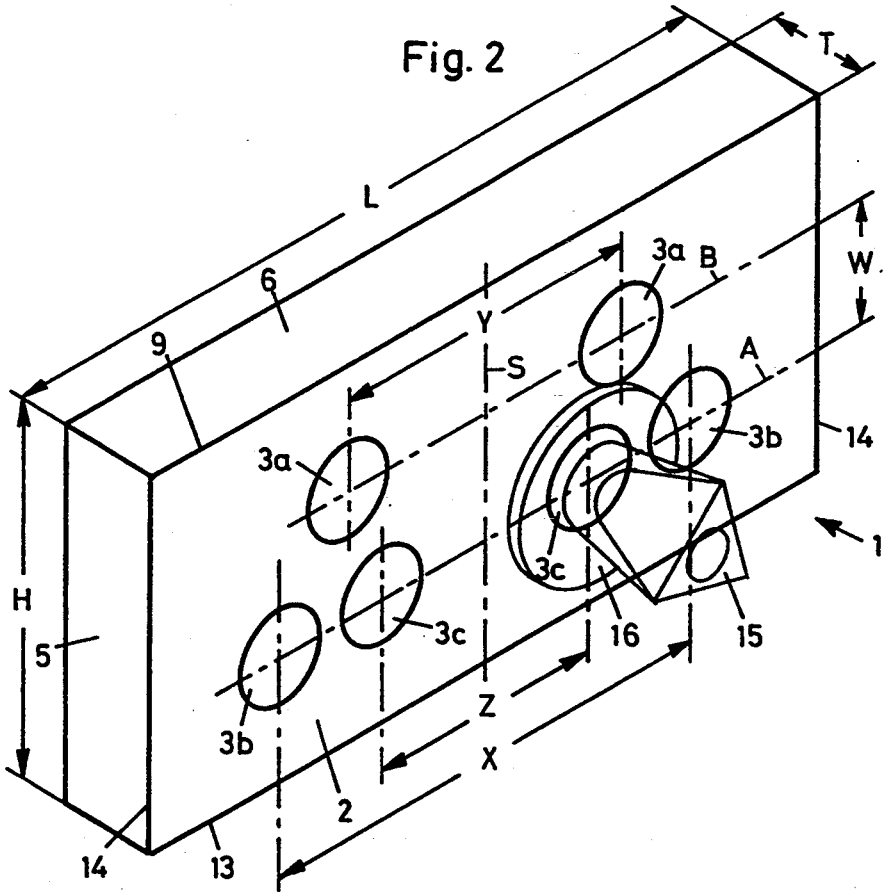
FIG. 2 is a schematic view of the attachment plate according to the invention with a sealing valve mounted thereon.

In the arrangement according to FIG. 2 an isolating valve 15 is mounted on the attachment plate 1. The breakthrough 3*c* used for the mounting is covered by a rosette 16. Clearly a second isolating valve 15 or another fitting may be mounted on the attachment plate 1.

Figure 3:
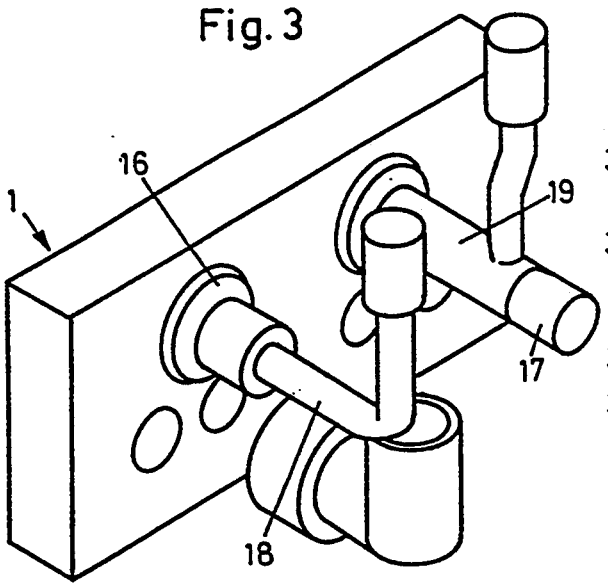
FIG. 3 is a perspective view of the attachment plate according to invention with a safety group mounted thereon.

FIG. 3 shows an attachment plate 1 on which is mounted a safety group 17. The latter has two conduits 18 and 19 which go through the two breakthroughs 3*a* and are mounted on them. Also in this case the breakthroughs are covered by rosettes 16.

Figure 4:
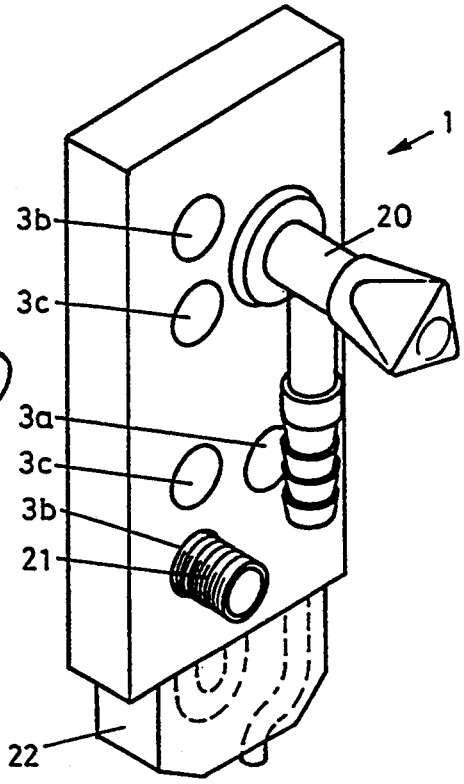
FIG. 4 is a perspective view of the attachment plate with washing fittings.

FIG. 4 shows an attachment plate 1 on which are mounted washstand fittings with a siphon trap 22 and a valve 20. In the case of this attachment plate a breakthrough 3*a* is used as well as a breakthrough 3*b*. Through the breakthrough 3*b* a screw neck 21 of the siphon trap 22 is guided from the rear.

Figure 5:
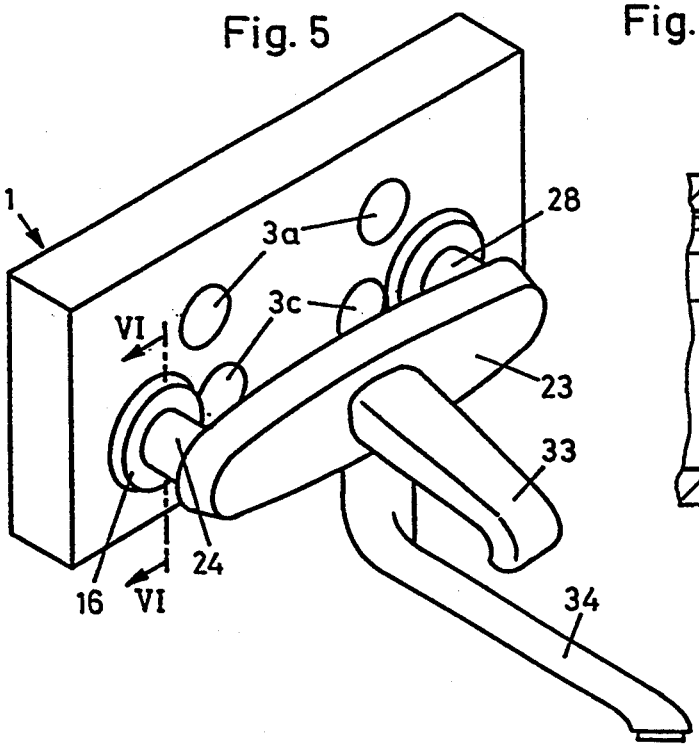
FIG. 5 is a perspective view of the attachment plate according to the invention with a fixture for cold and hot water mounted thereon.

FIG. 5 shows an attachment plate 1 on which is mounted a so-called mixed-water fixture 23. The latter comprises an actuation lever 33 as well as a spout 34. Lines 24 and 28 for warm or cold water, respectively., lead through breakthroughs 3*b*. Here also is provided in each instance a covering with a rosette 16. If the distance between the two lines 24 and 28 is shorter, breakthroughs 3*c* or 3*a* are used correspondingly. However, the use of a breakthrough 3*b* and a breakthrough 3*c* is also possible.

Figure 6:
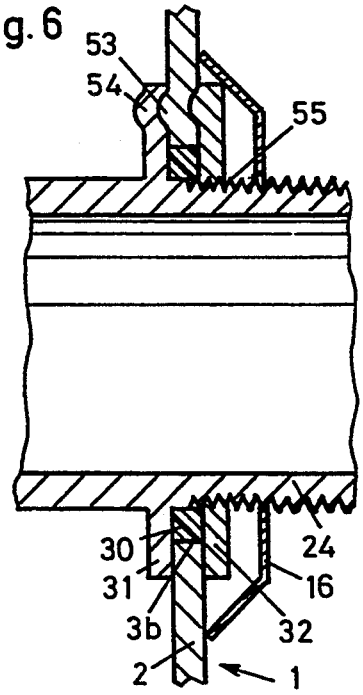
FIG. 6 is a section along line VI—VI in FIG. 5, in which parts of the fixture are omitted.

The mounting battery 23 on the plate 1 is shown in FIG. 6. Pipe 24 comprises an outer flange 31 which rests on the rear side of the front wall 2. On the opposite side of the front wall 2 is applied a counternut 32 which is screwed onto the outer threads 55. Between the flange 31 and the counternut 32 is placed in the breakthrough 3*a* a packing ring 30 made of a sound-absorbing material, for example rubber. Finally, a rosette 16 mentioned hereinabove is placed onto the line 24. The dimensions of the ring 30 depend on the outer diameter of line 24. In the case of a small outer diameter, a ring 30 with a smaller inner diameter is selected accordingly. Lateral displacement of line 24 is prevented in every case. Consequently lines 24 with different outer diameter may readily be mounted on the attachment plate 1.

Lugs 53 on the rear side of the front wall 2 which engage corresponding recesses 54 of the flange 31 facilitate the aligning of the fixture during the mounting operation. A suitable arrangement of these lugs 53 is shown in FIG. 1. In FIG. 2 these lugs 53 are not shown for reasons of clarity.

Figure 7:
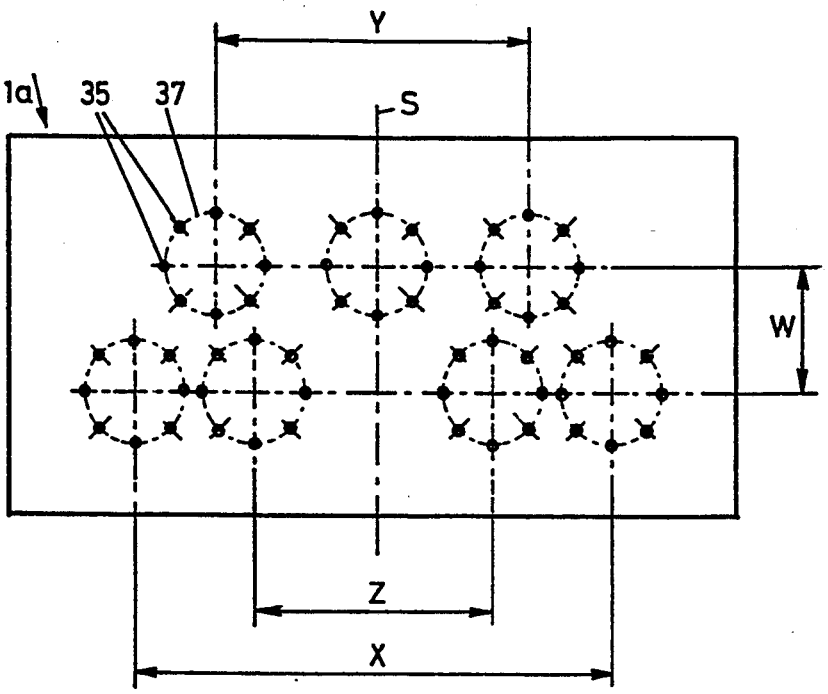
FIG. 7 is a front view of an attachment plate according to an embodiment for a flange mounting by means of self-tapping screws.
Figure 9:
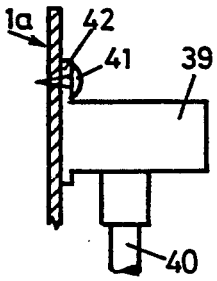
FIG. 9 is a schematic cross-section of the mounting of a fixture on the attachment plate according to FIG. 7.

FIG. 7 shows an attachment plate la in which each mounting site comprises eight bores 35 which are disposed in a circle 37. As shown schematically in FIG. 9 this plate serves for mounting fixtures 39 which comprise an outer flange 42. The latter may be mounted by means of tapping screws 41 which are screwed into bores 35. The lines 40 leading to the fixture 39 in this case do not pass through the attachment plate 1*a* and the corresponding breakthroughs may here be omitted.

Figure 8:
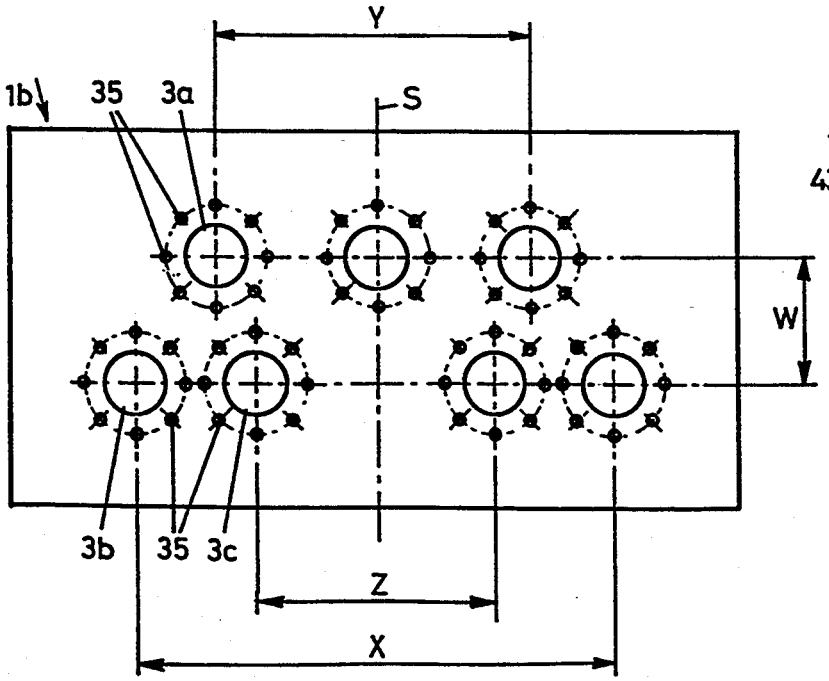
FIG. 8 is a front view of an attachment plate according to a further embodiment of the invention.
Figure 10:
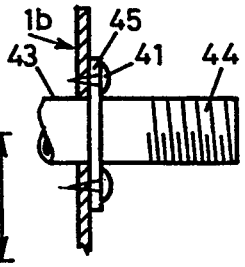
FIG. 10 is a schematic cross-section of the mounting of a fixture on the attachment plate according to FIG. 8.

In addition to the bores 35, breakthroughs 3*a* to 3*c* are provided in the implementation according to FIG. 8. In this case the mounting shown in FIG. 10 of a line piece 43 provided with a flange 45 is possible. The fitting is here screwed onto external threads 44 of the line piece 43. Here are self-tapping screws 41 screwed into corresponding bores 35 of the attachment plate 1*b*. Accordingly, a mounting site comprises in attachment plate 1*b* in each instance a breakthrough as well as several bores 35 disposed around it.

Figure 11:
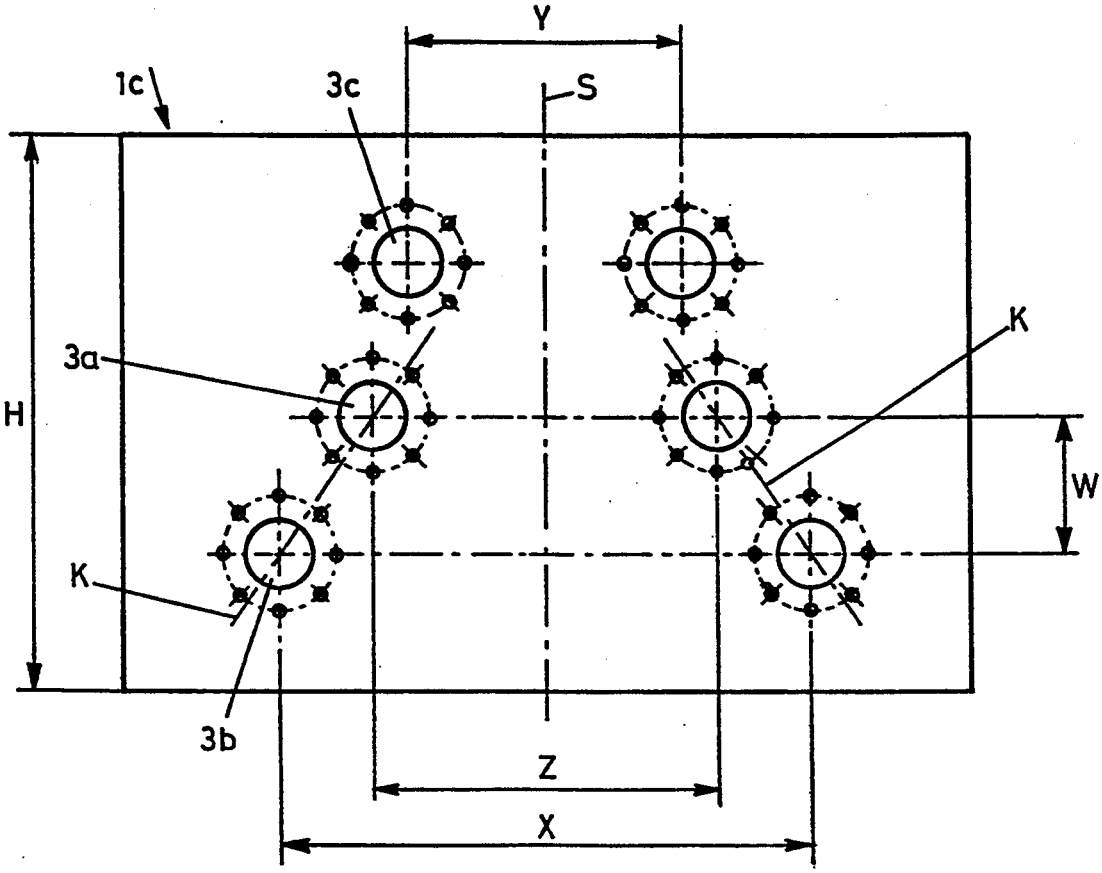
FIG. 11 is a front view of an attachment plate with two mounting mounting options.

Finally is shown in FIG. 11 an attachment plate which also comprises two groups each with three mounting sites. However, here two mounting sites or breakthroughs 3*a* and 3*b* are disposed on a straight line K extending obliquely and a third mounting site 3*c* is offset with respect to the former. The above stated distances X, Y, and Z, however, are also maintained in this implementation. In contrast with the other implementations described hereinabove, here a greater height H of the plate must be provided. The openings and latches, explained in connection with FIGS. 1 and 2, for mounting the attachment plate on a supporting frame 10 are also provided in the case of the attachment plates 1*a* to 1*c*. However, they are not shown in the corresponding Figures.

What is claimed is:

1. An attachment plate (1) for mounting sanitary fixtures, for example isolating valves, safety groups, corner valves and surface fixtures, in particular for installation on a building wall, wherein the attachment plate has four side walls (5,6) bent rearwardly from a front wall (2) at a right angle and wherein the front wall (2) and the four side walls (5,6) have recesses (4*a*,4*b*) for introducing latching means (15) therethrough, wherein the front wall (2) has at least two groups (3) disposed mirror symmetrically with respect to one another of at least three mounting sites (3*a*–3*c*), wherein in each group (3) at least two mounting sites (3*a*,3*b*) are disposed at a distance from one another with their centers essentially on a straight line (K) extending obliquely to an edge (13) of the plate (1), and the third mounting sites (3*c*) of each group (3) are disposed at a distance (Z)

therebetween different than the distances (X,Y) between the mounting sites (3*a*,3*b*) disposed on the straight line (K), wherein the average of the distances (X,Y) between the mounting sites (3*a*,3*b*) disposed on the straight line (K) differs from the distance between the two third mounting sites (3*c*).

2. The attachment plate according to claim 1, wherein the mounting sites (3*a*–3*c*) are circular breakthroughs.

3. The attachment plate according to claim 2, wherein the breakthroughs (3*a*–3*c*) have a diameter of approximately 33 mm.

4. The attachment plate according to claim 1, wherein the mounting sites (3*b*) and (3*c*) have distances (X, Z) of 150 to 156 and 73 to 79 mm, respectively, and the distance of the third mounting sites (3*a*) one from the other is 95 to 105 mm.

5. The attachment plate according to claim 1, wherein the distance (Y) between the mounting sites (3*a*) is approximately 100 mm, and the distances (X, Z) between the mounting sites (3*b*) and (3*c*) disposed on the straight line (A) are approximately 153 or approximately 76.5 mm, respectively.

6. The attachment plate according to claim 1, wherein the side walls (5, 6) have projections (7) for positioning the attachment plate (1), on a supporting frame (10).

7. The attachment plate according to claim 1, wherein the front wall has a length of 240 to 260 mm, and a width of 110 to 130 mm.

8. The attachment plate according to claim 1, wherein the mounting sites have bores (35) for receiving self-tapping screws (41).

9. The attachment plate according to claim 1, wherein the mounting sites have at a rear of the front wall (2) projecting lugs (53) for positioning a fixture.

* * * * *